US006113001A

United States Patent [19]

Sant et al.

[11] Patent Number: 6,113,001

[45] Date of Patent: Sep. 5, 2000

[54] LIQUID SUPPLY APPARATUS

[75] Inventors: Andrew Jonathan Sant; Richard Wilhelm Janse Van Rensburg; Matthew Alexander Schumann; Victor Carey Humberstone, all of Cambridge, United Kingdom

[73] Assignee: The Technology Partnership PLC, Royston, United Kingdom

[21] Appl. No.: 09/125,269

[22] PCT Filed: Feb. 10, 1997

[86] PCT No.: PCT/GB97/00372

§ 371 Date: Aug. 13, 1998

§ 102(e) Date: Aug. 13, 1998

[87] PCT Pub. No.: WO97/29851

PCT Pub. Date: Aug. 21, 1997

[30] Foreign Application Priority Data

Feb. 13, 1996 [GB] United Kingdom ..... 9602969

[51] Int. Cl.[7] ..... B05B 1/08; B05B 3/04

[52] U.S. Cl. ..... 239/102.2; 222/309; 222/383.1; 222/386.5

[58] Field of Search ..... 222/309, 372, 222/383.1, 385, 386.5; 141/27, 65; 91/422; 417/553; 239/102.2

[56] References Cited

U.S. PATENT DOCUMENTS

| | | | |
|---|---|---|---|
| 855,647 | 6/1907 | Mallonee | 417/553 |
| 2,353,069 | 7/1944 | Perkins | 417/553 |
| 2,800,254 | 7/1957 | Dinkelkamp | 222/260 |
| 5,533,879 | 7/1996 | Chen | 417/553 |

FOREIGN PATENT DOCUMENTS

| | | |
|---|---|---|
| 0084458 | 7/1983 | European Pat. Off. . |
| 0276097 | 7/1988 | European Pat. Off. . |
| 2240161 | 3/1975 | France . |
| 79623 | 4/1894 | Germany . |
| 60-204356 | 10/1985 | Japan . |
| 60-204364 | 10/1985 | Japan . |
| 9116997 | 11/1991 | WIPO . |

*Primary Examiner*—Henry J. Recla
*Assistant Examiner*—Timothy L. Maust
*Attorney, Agent, or Firm*—Dykema Gossett PLLC

[57] ABSTRACT

A liquid supply apparatus having a receptacle for containing a liquid to be supplied, air and a controlling means having a valve for controlling the volume of air in the receptacle. Liquid is supplied through an outlet from the receptacle. The receptacle is controlled so the liquid supplied to the outlet is at a negative pressure while the liquid is moved to an outlet.

21 Claims, 6 Drawing Sheets

LIQUID SUPPLY APPARATUS

Figure 1:
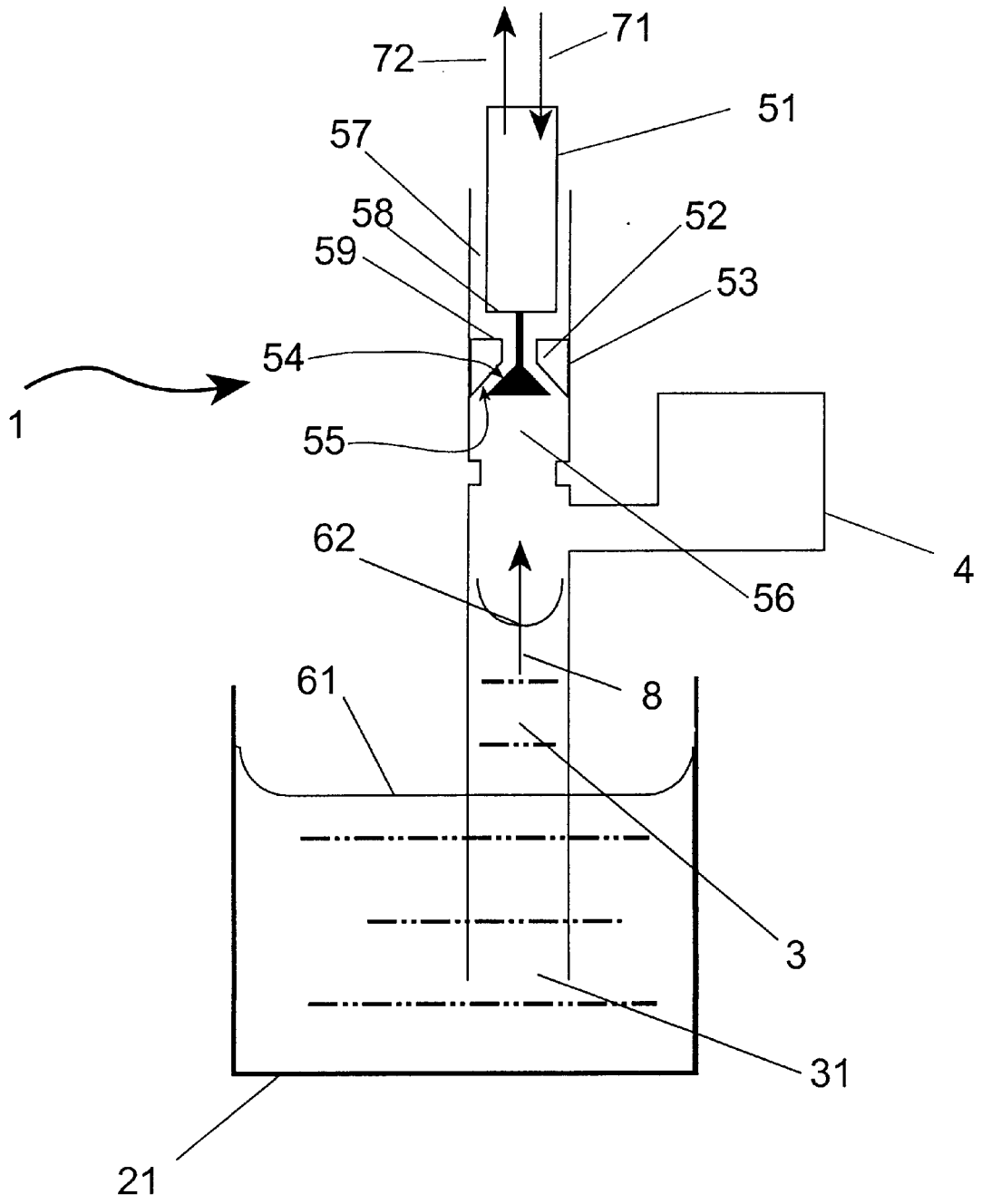

The present invention relates to apparatus and methods for supplying liquids (which term includes liquid suspensions).

In some circumstances it is desirable to supply liquid, including for example suspensions containing particles which tend to separate out, at less than or at most ambient pressure. For the purposes of the present application a pressure either less than the ambient pressure or equal to the ambient pressure will be referred to as negative pressure.

The supply may be to a liquid receiving or dispensing means and may be from and to a liquid container. The containers may be of the type wherein the liquid within the container has a surface that is exposed to the ambient environment or containers wherein the liquid within the container is sealed from the ambient environment. Where the type of container is important to the description and the sense is not clear from the context we shall refer to these as 'open containers' or 'closed containers' respectively.

It is often necessary in liquid supply applications to transport liquid at controlled pressures and flow rates. In practical situations the means used typically comprises a liquid storage container, a pump, and a liquid supply conduit. The supply conduit may terminate, for example, in an open nozzle from which liquid may be supplied, for example for applying lubricating oil to rotating mechanical components, or it may terminate in say a regulating valve to provide flow rate control, for example for delivery of petroleum from a fuel tank to the carburetor of an internal combustion engine.

Where the liquid supply means incorporates a pump the liquid is typically subjected to positive pressures in order to transport the liquid to its point of delivery. The liquid will therefore typically arrive at its point of delivery at pressures equal to or above ambient pressure (which may often be the atmospheric pressure).

Where the liquid supply means does not include a pump, the liquid can ordinarily only be supplied to a level equal to or below that of the liquid level in the container. In this circumstance the hydrostatic pressure in the container provides the driving force required to transport the liquid to a position of equivalent or lower hydrostatic pressure. At its point of delivery the liquid will again typically be at a pressure equal to or greater than ambient pressure.

An object of the present invention is to provide apparatus to supply liquid from a container to liquid receiving or dispensing means at a pressure either less than or equal to the ambient pressure.

According to the present invention there is provided a liquid supply apparatus comprising

- a receptacle for containing in use a liquid to be supplied and air;
- means for controlling the volume of air in the receptacle;
- an outlet from the receptacle through which liquid is supplied in use; and
- means for enabling liquid to be moved to the outlet while controlling the volume of air in the receptacle in order that the liquid supplied to the outlet is at negative pressure.

In one embodiment of the present invention the apparatus may comprise a liquid supply conduit having rigid walls, one end of which is open and which in use is immersed in liquid; an expandable chamber that is in pressure-transmitting relation to the interior volume of the conduit and operable to provide interior volume change between the chamber and the open end of the conduit; and a valve between the interior volume of the conduit and/or the expandable chamber and the ambient atmosphere that is operable to open and close which, when open, allows at least air or other gases to be admitted into and exhausted from said interior volume and when closed prevents such admission or exhaustion; such that the expandable chamber is mechanically linked to the valve so that expansion of the interior volume of the chamber maintains the valve in a closed state.

The term 'rigid' is used throughout to mean 'does not significantly distort under the pressures or forces experienced during operation of the apparatus'. With respect to the conduit it indicates that, during operation, the material of which the conduit walls are made do not expand or contract substantially and correspondingly that the interior volume of the conduit does not change substantially. The term 'conduit' is used throughout to denote a passageway for, and constraining the flow of, fluids, i.e. of liquids and gases. It does not imply constant cross-sectional area along the length of the passageway, but includes passageway regions of locally enlarged and reduced cross-section.

The liquid in which, in use, the open end of the conduit is immersed, may conveniently be maintained in either an open or a closed container.

Advantageously the mechanical linkage between the expandable chamber and the valve is such that the valve remains closed as the expansion of the expandable chamber comes to a halt. This allows liquid taken up through the conduit to be maintained in its uptaken position when the expansion of the chamber comes to rest. Advantageously also, the mechanical linkage between the expandable chamber and the valve is such that the valve opens when, and is maintained open whilst, the interior volume of expandable chamber reduces. This allows return of the liquid to the liquid supply without inducing large pressures in the apparatus.

The intermediate length of the conduit between the expandable chamber and the open end of the conduit may at least partially extend above the level of the liquid surface. In this way liquid may be drawn upwards against gravity from the liquid container by expansion of the chamber and thereby be supplied to a liquid receiving or dispensing means at a pressure either less than or equal to ambient pressure, and be returned (at least partially) to said container by the action of hydrostatic pressure upon the opening of said valve to ambient pressure. In such a use, for liquid return to the container, the chamber may often without disadvantage be operated to decrease partially the volume of the conduit (i.e. towards its original volume) before the valve opens and, after the valve has opened, fully to return to its original volume.

The expandable chamber may advantageously comprise a piston either interior to or exterior to the walls of the conduit, sealing to the conduit, and capable to move along the length of the conduit. This creates a very simple form of expandable chamber comprising part of the conduit and which form of expandable chamber is conveniently disposed to the cyclic operation of supply of liquid to, and withdrawal of liquid from, liquid receiving or dispensing means. In this case, the valve may conveniently take the form of an impermeable material assembly forming a seal to the walls of the conduit, displaced along the conduit length by the piston movement, and forming a seal to the piston only when the piston is either moving to increase the interior volume of the conduit between the piston and the open end of the conduit or when the piston comes to rest after displacing in that direction. In this case also, the valve may conveniently take the form of an impermeable material assembly forming a seal to the sidewalls of the piston as the piston is displaced along the conduit length, whereby said component also forms a seal to said conduit only when either said piston displaces in the direction of increasing conduit interior volume or when said piston comes to rest after displacing in that direction.

Additionally means may be provided to effect the expansion or contraction of the expandable chamber by a rotating motion. In the case where a piston is used, as described above, a mechanical spiral thread can convert the rotating motion of an outer casing into a linear motion of a piston or other volume-change means to expand the volume of the chamber. This allows a simple user-action in hand-operated implementations of the present invention.

The apparatus may also advantageously include a liquid-impermeable pressure-transmitting membrane attached to the walls of the conduit and forming a liquid-tight seal of the conduit between the expandable chamber and the open end of the conduit, where the membrane is capable, responsive to pressure differences between the expandable chamber and the open end of the conduit, to expand and to reduce the interior conduit volume between the membrane and the open end of the conduit. Incorporation of this membrane allows liquid uptake and discharge without liquid contacting the valve, which feature is particularly advantageous if the liquid is resinous or a dense suspension of solid particulates, when liquid contact to the valve could cause blockage of the valve.

The apparatus may also be used in conjunction with liquid receiving or dispensing means in fluidic contact with the interior volume of the conduit between the expandable chamber and the liquid-immersed end of the conduit. Such liquid receiving means can, for example be a liquid metering chamber or a reagent layer that is, for example, chemically-sensitive to the liquid. Such liquid dispensing means may advantageously be capable to discharge liquid from that interior conduit volume to the ambient environment outside the conduit. Particularly advantageous use of the apparatus arises with those types of liquid dispensing means themselves able to maintain a continued replenishing supply of liquid from the liquid source to the dispensing means as liquid is dispensed therefrom once direct fluidic contact between liquid receiving or dispensing means and the container is established by the action of the expandable chamber and valve.

The liquid receiving or dispensing means may, advantageously in some applications, be located at a height above the upper surface of the liquid of the liquid source so that, in use, that receiving or dispensing means receives liquid at a pressure lower than the ambient pressure outside the conduit and may discharge uptaken liquid back to the liquid supply by the action of gravity acting on the liquid when the valve is opened to ambient pressure.

In embodiments incorporating also the membrane referred to above, the liquid dispensing or receiving means is disposed between the membrane and the open end of the conduit.

Particularly advantageous dispensing of liquid from the apparatus arises through use of forms of liquid dispensing means incorporating one or more perforations, known for example in the arts of 'ink jet' and of the production of liquid aerosol sprays by electromechanical excitation either of the liquid interior to the perforations or of material regions defining those perforations. Of particular note are the apparatus for liquid aerosol sprays disclosed in U.S. Pat. No. 4,533,082, U.S. Pat. No. 4,605,167, U.S. Pat. No. 4,796,807, U.S. Pat. No. 4,602,538, EP 0 655 256 A2, U.S. Pat. No. 5,729,724, U.S. Pat. No. 3,812,854, EP 0 480 615 A1, GB 92/11050, EP 0 516 565 A1, U.S. Pat. No. 5,152,456, GB 2 261 494, EP 0 542 723, PCT/GB92/02262, PCT/GB94/02692. With such dispensing apparatus, it is advantageous for there to be present a seal covering the orifices of those perforations at the exterior face of the conduit during the expansion of the chamber and the consequent uptake of liquid into the conduit, at least until the orifices of those perforations at the interior face of the conduit are contacted by the uptaken liquid. Said seal may thereafter be displaced to allow liquid dispensation from the conduit to the ambient environment.

According to a second embodiment the apparatus may comprise a rigid casing defining a container (forming the receptacle); a liquid conduit penetrating through that casing and having one end with opening within the interior volume of the container and a second end with opening exterior to the container, thereby providing a liquid passageway between the interior volume of the container and the exterior environment; an aperture penetrating through the casing and sealed against liquid ingress or egress by an impermeable pressure-transmitting membrane capable to expand and to reduce that volume of the container that lies interior to both the membrane and the casing responsively to pressure differences across the membrane, and which in use is at least partially filled with liquid.

The membrane denoted above is a separate membrane to that disclosed in the first embodiment of the invention and, for the avoidance of doubt, is therefore in the specification hereinafter referred to as the 'second membrane'. The conduit denoted above is a separate conduit to that disclosed in the first embodiment of the invention and, for the avoidance of doubt, is therefore hereinafter referred to as the 'second conduit'.

Apparatus according to this second embodiment of the invention may also include a removable seal capable to seal that opening of the second conduit that is exterior to, or at the exterior surface of, the container. This seal is a separate seal to that disclosed in the first aspect of the invention and so is referred to hereinafter as the 'second seal'.

The second seal allows simple liquid containment regardless of the orientation of the container. The second seal may be replaceable. This allows multiple actions, in each of which partial dispensing of liquid from the container may occur and after each of which the second seal may be replaced, thereby again allowing liquid containment between dispensing actions regardless of the orientation of the container.

In apparatus without the second seal, liquid containment is achieved by maintaining the container oriented such that the upper surface of liquid within the container remains at lower height than the height of the conduit opening that is open to the exterior of the container.

Apparatus according to the second embodiment may be used as a liquid dispensing means.

In a first method of liquid dispensing (using the apparatus of the second embodiment) the second seal, if present, is removed and the apparatus is re-oriented from a first orientation, in which the upper surface of contained liquid is at a height below the height of that conduit opening which is open to the exterior of the container, to a second orientation such that the upper surface of the liquid is displaced to a height above the height of that conduit opening. Liquid thereby exits from the container via the open end of the liquid conduit at or outside the external face of the casing of the container. On returning the container to its original orientation, air may enter into the container to replace liquid discharged therefrom.

Apparatus to be used according to this dispensing method may have the interior volume of that portion of the second conduit interior to said container larger than or smaller than the maximum volume to which the second membrane may expand within the container. In the case where the interior volume of that portion of the second conduit interior to said container is the larger, then the maximum volumetric discharge of liquid from the container on the reorientation is limited by that maximum volume of the second membrane. In the case where the maximum volume to which the second membrane may expand within the container is the larger, then the maximum volumetric discharge of liquid from the container on the reorientation is limited by that maximum volume of the interior volume of that portion of the second conduit interior to said container.

In a second method of liquid dispensing: the end of the second conduit which is interior to the container is immersed in liquid; the second seal, if present, is removed; and the open end of the second conduit at or outside the external face of the casing of the container is exposed to a reduced pressure such that the pressure in that region is lower than the pressure at that surface of the second membrane exposed to the container aperture. Liquid is thereby drawn out of the container. On removing the source of reduced pressure at least partial return of liquid within the second conduit into the container may be effected.

According to this second method the maximum volume that may be withdrawn from the container in any one cycle of pressure reduction followed by pressure restoration may conveniently be limited by the maximum volumetric expansion of the second membrane. Again, it may be arranged that air enters into the container to replace liquid discharged from it, allowing the second membrane to at least partially collapse and thereby to allow multiple discharge operations to the fully expanded second-membrane volume.

An advantageous means to provide the reduced pressure inducing liquid delivery described above is the apparatus described in accordance with the first embodiment of the invention. This allows, for example, the creation of liquid dispensing products comprising a liquid container that is separable from an apparatus for the supply of liquid to a liquid receiving or dispensing means according to the first embodiment of the invention. This allows for example, products in which the first embodiment of the invention forms a part of a product that is reusable and the second embodiment of the invention forms a part of a product that is removable from that first part and is refillable or disposable.

In apparatus according to the second embodiment of the invention and particularly when used according to the second method described above, the second membrane may advantageously have surface area greater than the minimum area enclosed by the seal that it forms with the walls of the container. In this way it is capable to expand and to reduce the interior volume of the container without substantial stretching of the material of which it is comprised, and so with very low pressure drop across the membrane opposing the expansion or contraction.

This invention therefore provides a relatively simple and low cost apparatus for supply of a liquid receiving or dispensing means, particularly for that supply at a pressure less than or equal to the ambient pressure.

A second advantage of this invention is that a relatively simple and low cost apparatus can provide a wide range of geometrical layout arrangements of the container relative to the liquid receiving or dispensing means.

A third advantage of this invention is the provision of a relatively simple and low cost apparatus that can supply liquid to a receiving or dispensing means against the action of gravity, and to return excess liquid not received by or dispensed from the liquid receiving or dispensing means to the container without the need for applying a pressure greater than ambient pressure to the liquid supply conduit. This is particularly advantageous for supply of liquid to liquid receiving or dispensing means such as those of the 'ink jet' or 'electromechanical aerosol' arts referred to above whose functionality is impaired when the liquid is subject to pressures greater than ambient pressure. In this circumstance said supplied liquid will return at least in part to the container under the action of the hydrostatic head of the liquid in the conduit.

A fourth advantage of this invention is that for supply of some liquids containing volatile or sedimenting components at a pressure less than ambient pressure, said liquid receiving or dispensing means may be arranged to be in contact with said supplied liquid only when said means is prepared for receiving or dispensing said liquid. In this circumstance said liquid receiving or dispensing means is not subject to disadvantageous effects of evaporative deposition and particulate sedimentation which would otherwise be encountered if said supplied liquid was not withdrawn from said receiving or dispensing means. This is particularly important for nozzle and multi-nozzle types of liquid dispensing means dispensing such particulate liquid suspensions. Many such suspensions segregate to form a sediment layer at local low points of their container or liquid feed, particularly the bottom of a liquid container. Sedimented agglomerates can block the nozzles of such types of dispensing means if that means is located at or near such a locally low region and sedimentation is allowed to occur there. Firstly, the apparatus of the present invention allows such suspension liquids to be brought to such nozzle-type dispensing means only when the dispensing means is required to dispense the liquid. In this way such sedimentation and consequently nozzle blockage is prevented or alleviated. Secondly the apparatus of the present invention enables liquids, including suspension liquids, to be raised (against gravity) to reach such dispensing means so that the dispensing means lies above sedimenting regions of the container or conduit. In this way also blockage is alleviated or prevented. Thirdly, the action of drawing up such sedimented liquids has been found advantageously to disturb the sediment and partially or fully to re-disperse it before the dispensing means is required to dispense the liquid. In this way also the present invention is useful for the supply of suspensate liquids.

Examples of apparatus according to the invention will now be described by way of example only with reference to the accompanying drawings, in which:

FIG. 1: is a schematic section of a first liquid supply apparatus incorporating an 'open container'

Figure 2:
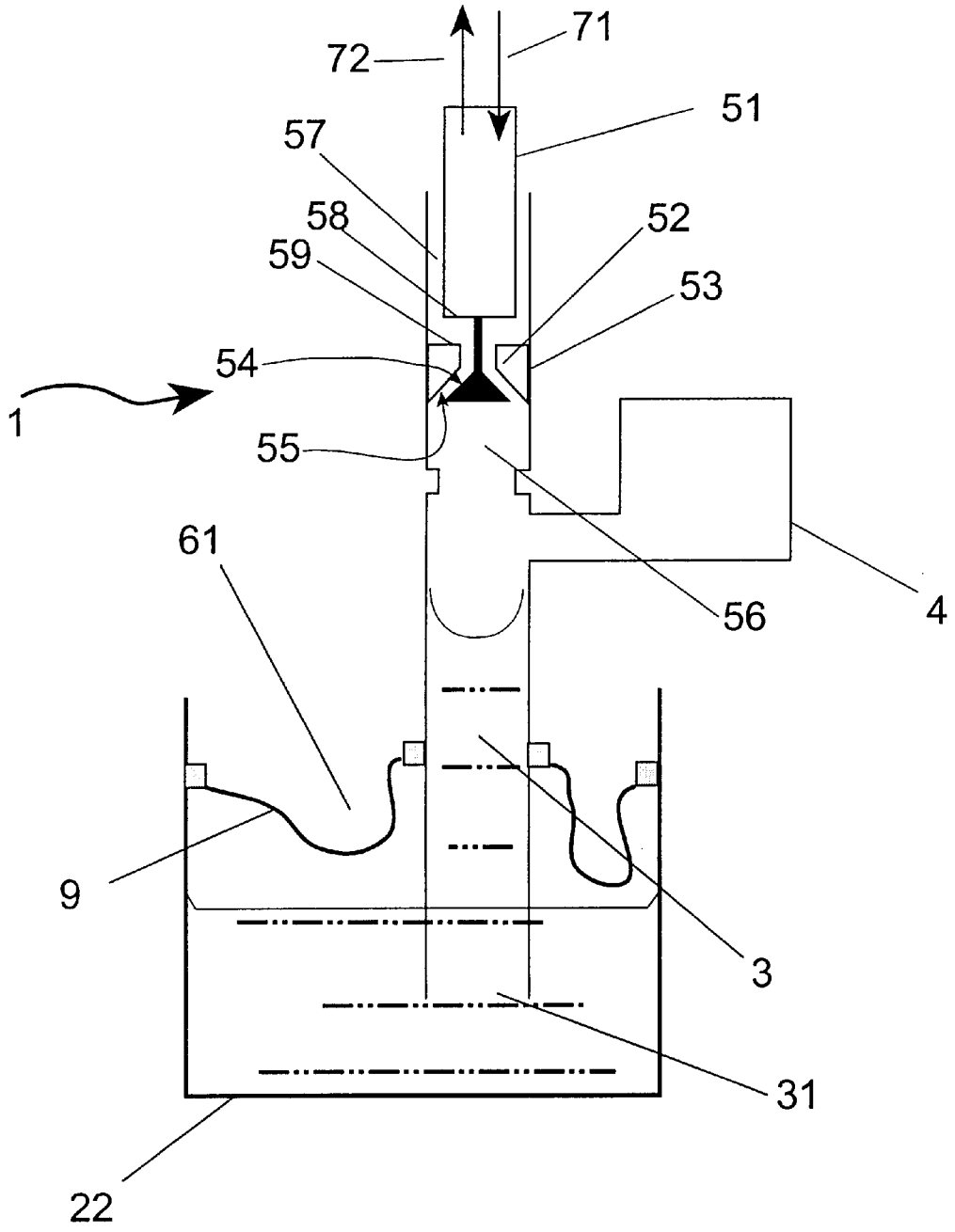

FIG. 2: is a schematic section of a second liquid supply apparatus incorporating a 'closed container'

Figure 3:
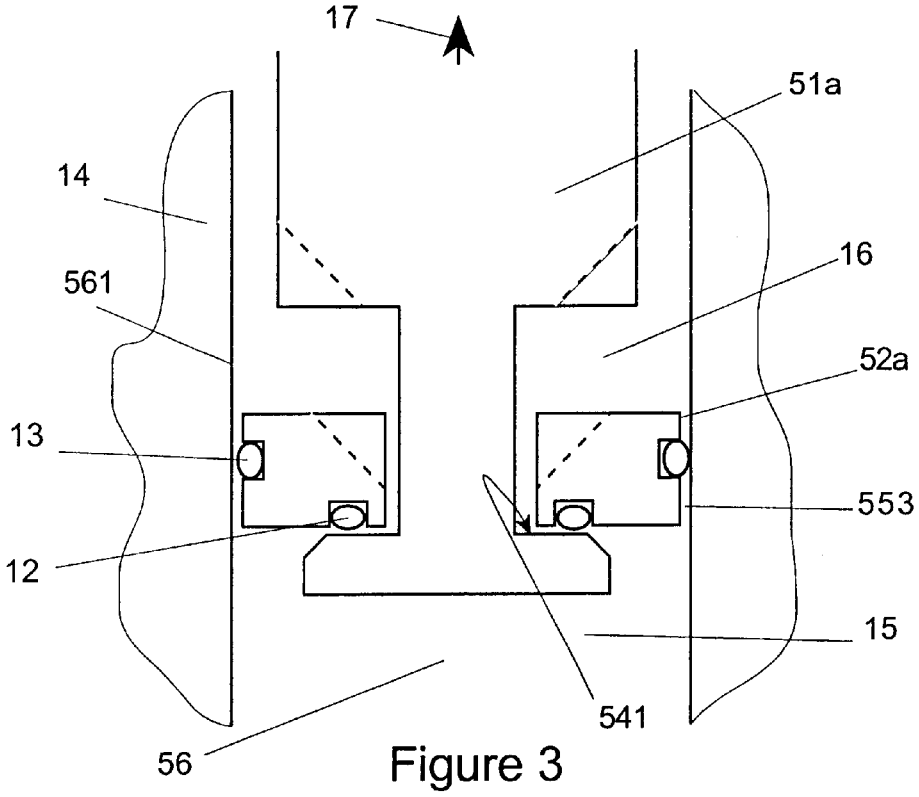

FIG. 3: is a schematic section of a piston form of expandable chamber used in the first and second examples incorporating a valve mechanism with that valve "closed"

Figure 4:
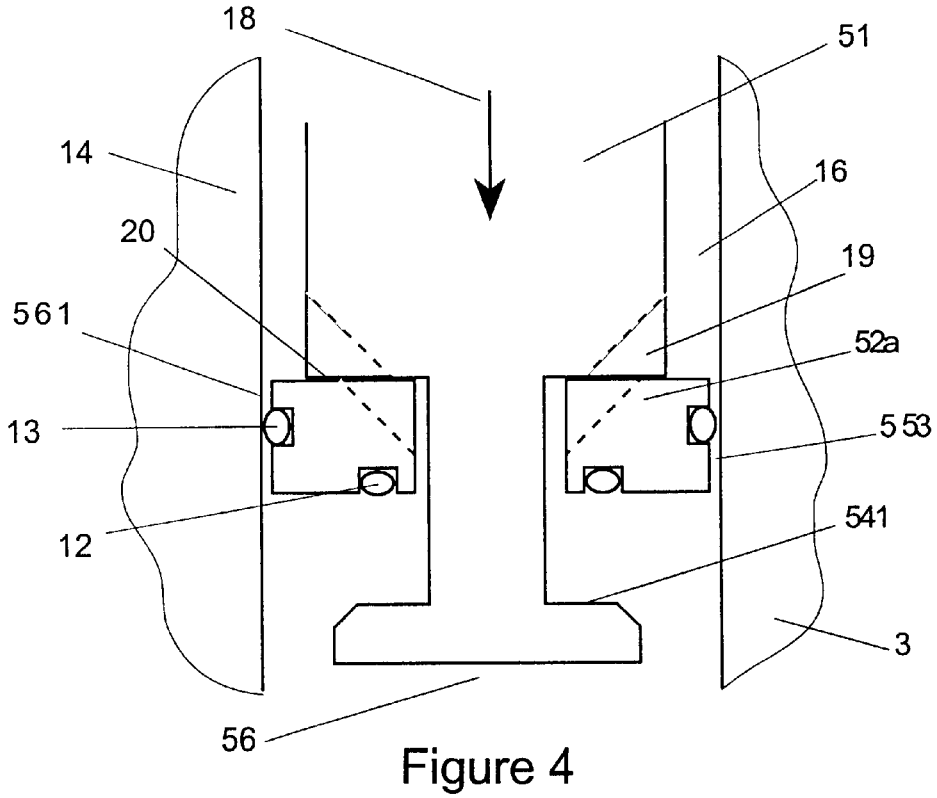

FIG. 4: is a similar schematic section with that valve "open"

Figure 5:
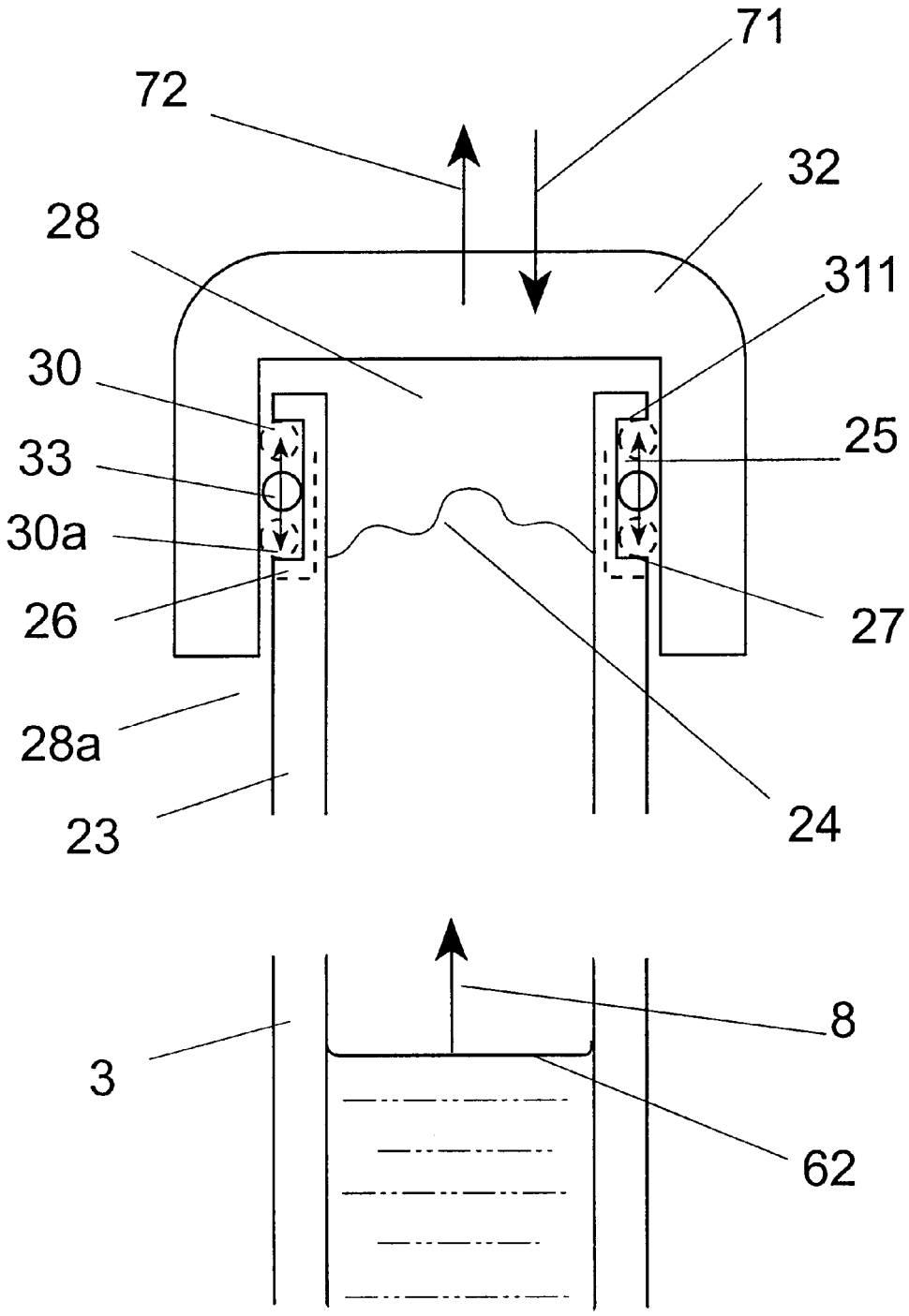

FIG. 5: is a schematic section of a further piston-form of expandable chamber integrated with a valve and with that valve "open"

Figure 6:
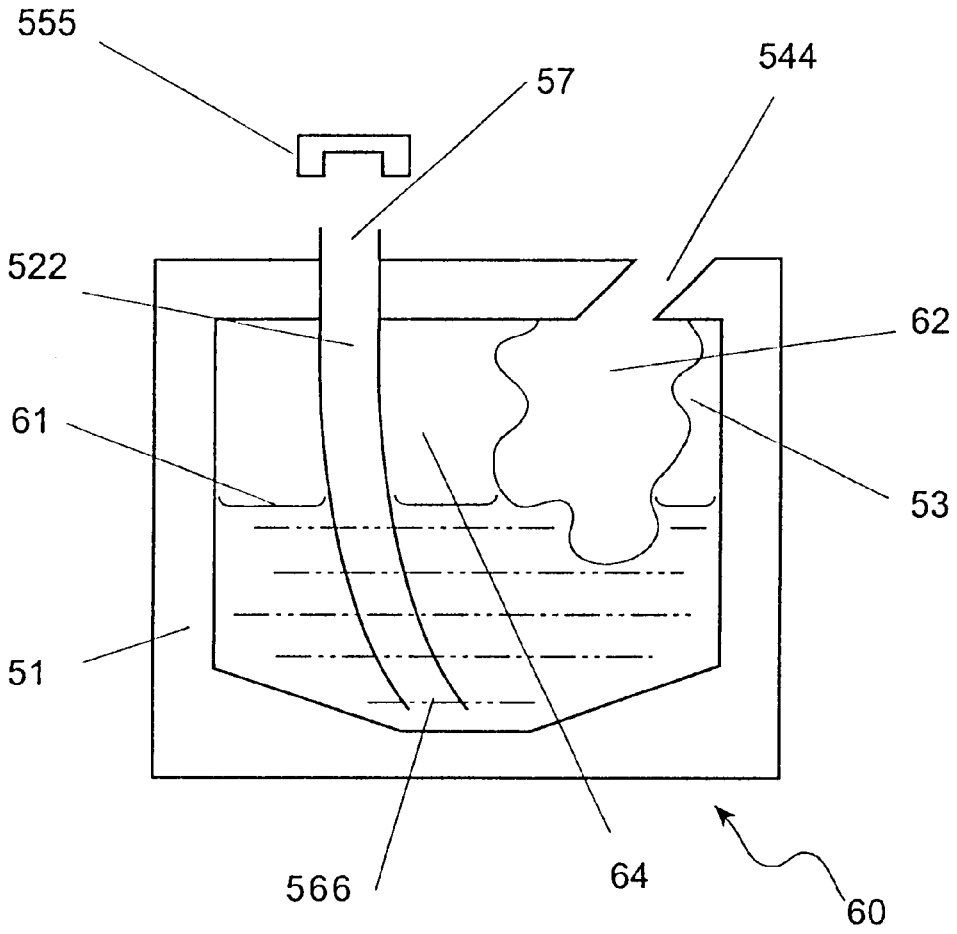
Figure 8:
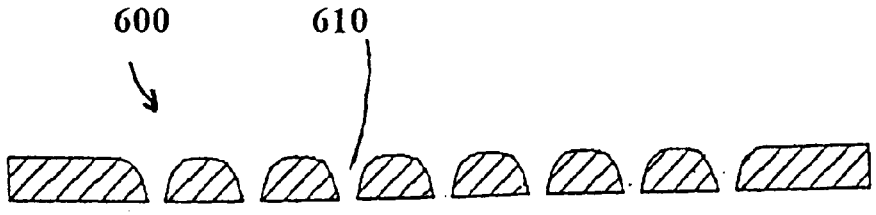
Figure 7:
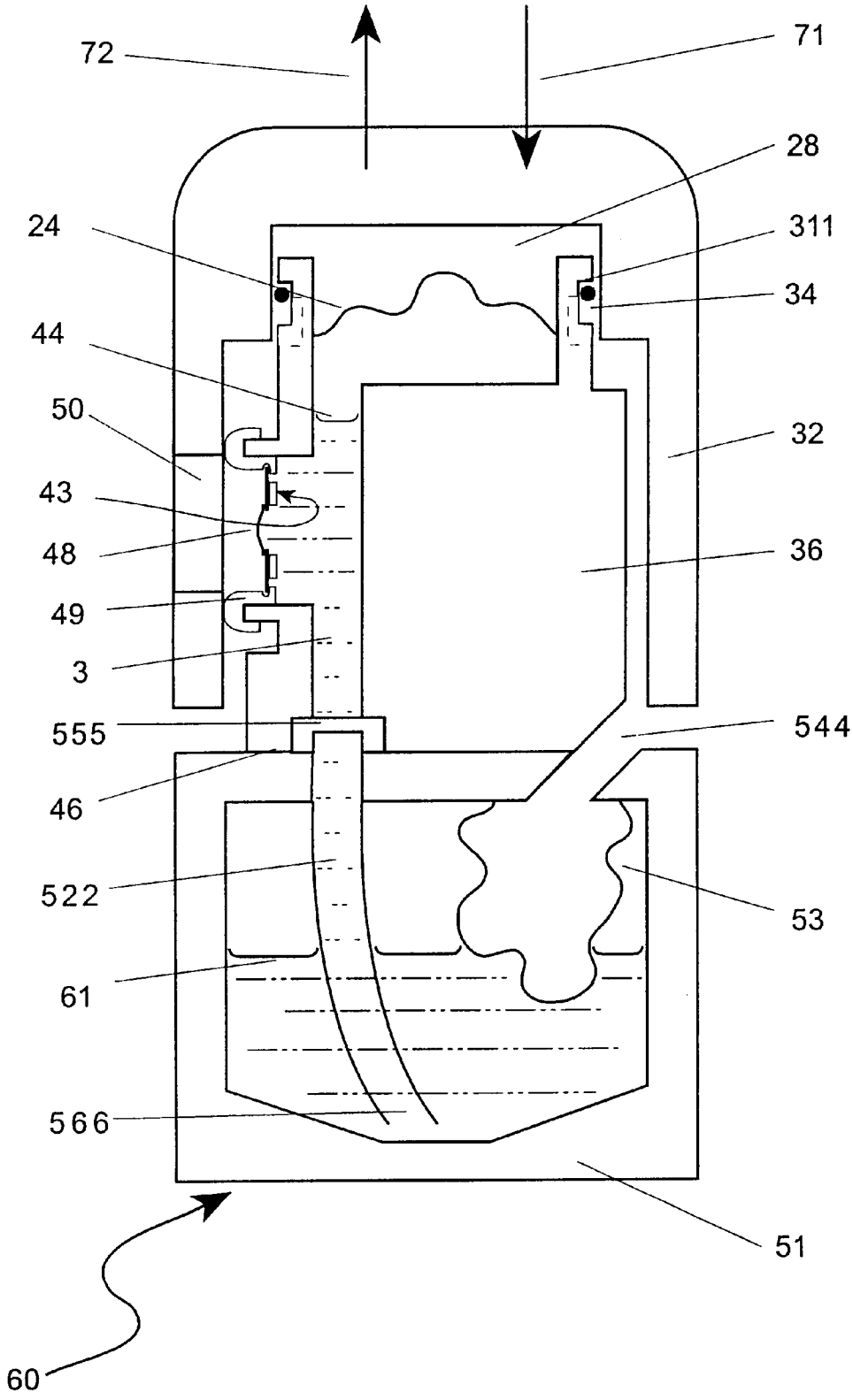

FIG. 6: is a schematic section of a liquid containment and delivery apparatus according to the second embodiment of the invention FIG. 7: is a schematic sectional view of a liquid supply apparatus combining elements according to both the first and the second embodiments of the invention FIG. 8: is a schematic sectional view of a liquid droplet generating means.

FIG. 1 shows a liquid supply apparatus 1, described in more detail below, connected to an 'open vessel' 21 containing liquid. The pressure at the liquid surface 61 of the vessel 21 is maintained at ambient pressure.

Liquid is transported from the vessel along a liquid supply conduit 3 of the apparatus to a liquid receiving or dispensing means 4 by means of an expandable chamber and valve in the form of a cooperative assembly of a plunger 51 and a shuttle 52 within the conduit 3. The surface 53 of the shuttle 52 contacting the interior wall of the conduit 3 maintains a seal to that wall as it is displaced in both directions along the conduit.

Displacement of the plunger 51 in the direction shown by the arrow 71 separates the surface 54 of the plunger from the surface 55 of the shuttle, opening the interior volume of the conduit to ambient pressure via an air passageway 57. Continued displacement in that direction causes surface 58 of the plunger to bear on the surface 59 of the shuttle and pushes the shuttle towards the lower end 31 of the conduit 3, which is immersed in liquid. Surfaces 58 and 59 are arranged so that they do not form a seal when they are so in contact. Therefore, as the plunger and shuttle displace in the direction of the arrow 71, air (or other gas) within the conduit escapes to the ambient surroundings by means of the passageway 57.

Conversely, displacement of the plunger in the direction shown by the arrow 72 brings the surface 54 of the plunger into sealing contact with the surface 55 of the shuttle, so closing the interior volume of the conduit 3 from ambient pressure. Continued displacement of plunger 51 in the direction shown by arrow 72 after contact between surfaces 54 and 55 expands the interior volume of conduit 3 by the action of the plunger pulling the shuttle in the direction of arrow 72.

In this way the plunger 51 and shuttle 52 cooperate to form a rigid movable closure element and valve within the conduit 3, and they further cooperate with the conduit 3 to form an expandable chamber 56 in pressure-transmitting relation to the interior volume of said conduit.

The above is one simple example of an expandable chamber that is mechanically linked to a valve, wherein the valve lies between that chamber and the ambient environment, such that (a) expansion of the interior volume of the chamber maintains the valve in a closed state, (b) the valve may remain in a closed state after the expansion of the chamber ceases, and (c) the valve may open when that chamber volume is decreasing.

Plunger 51 and shuttle 52 may more simply and without loss of generality be described as forming a 'piston/valve assembly' rather than a ''rigid movable closure element' and valve assembly', as is apparent from the figure. Where that term is used hereinafter, no limitation to geometrical forms commonly referred to as 'pistons' is implied or is to be inferred.

In use, the movement in direction shown by arrow 72 causes the valve to close and the volume of chamber 56 to expand, thereby reducing the pressure in liquid supply conduit 3. Since the liquid surface 61 within the vessel 21 remains at ambient pressure liquid is caused to flow towards the liquid receiving or dispensing means from the vessel 21 as shown by the arrow 8. Hereinafter, this part of the cycle of operation may be referred to as a 'priming' stroke.

When a portion of conduit 3 intermediate between the lower end 31 immersed in liquid and the expandable chamber 56 lies above the level of the liquid surface 61, the liquid in the conduit at heights between surface 62 of liquid in the conduit 3 and surface 61 in the vessel is at a pressure lower than the ambient pressure outside the conduit. This is advantageous when certain types of liquid dispensing apparatus, described further below, form an additional part of the apparatus. It also allows liquid to return to vessel 21 under the hydrostatic pressure head of the liquid within the conduit when the volume of the chamber 56 is reducing and the valve is open. Hereinafter, this part of the cycle of operation may be referred to as a 'de-priming' stroke.

FIG. 2 shows liquid supply apparatus 1 connected to a 'closed vessel' 22 incorporating an impermeable pressure-transmitting membrane 9. Liquid can be supplied to or withdrawn from the liquid receiving or dispensing means by means of a cyclic displacement of the piston/valve mechanism already described with reference to FIG. 1. As liquid flows towards or returns from the receiving or dispensing means 4, flexible membrane 9 expands or contracts to maintain the liquid level 61 at or near ambient pressure.

FIG. 3 shows, by way of further example only, a detailed form of a shuttle 52*a* and plunger 51*a* mechanism as described in FIG. 2. Here a shuttle shown at 52*a* and a plunger 51*a* form a piston/valve mechanism with the valve part of the mechanism "closed". These components are located within rigid walls 561 of an expandable chamber 56, which may be either a separate component from, or an extension of, the conduit 3. The valve seal is formed between a surface 553 of the plunger and the shuttle by an elastomeric sealing material 12 that also seals to the shuttle and which can conveniently take the form of an O-ring seal. The sliding seal between the shuttle 52*a* and expandable chamber 56 is formed by a second elastomeric sealing material 13, which again may conveniently take the form of an O-ring between the shuttle and the sidewalls 561. The seals will be described below for convenience only with reference to the O-ring form. The valve is formed by surface 553 making and breaking a seal against sealing O-ring 12. The valve is closed when the plunger 51*a* is displaced upwards as shown by the arrow 17 so as to be in continuous intimate contact with O-ring 12, thereby sealing airspace 15 from airspace 16.

FIG. 4 shows the piston/valve mechanism of FIG. 3 with the valve part of the mechanism "open". In this position the plunger 51*a* is displaced so that the seal between surface 553 of the plunger and the surface of the O-ring that also seals to the shuttle is broken. Air channels 19, for example formed as radially-extending slots at certain circumferential positions within the shuttle and the plunger, enable air to flow past the plunger 51*a* and shuttle 52*a* even when shoulder 20 is in contact with shuttle 52*a*, thereby resulting in air space 15 being directly connected to air space 16 which itself is directly connected to the ambient environment. The pressure within airspace 15 and therefore within the liquid conduit is thereby increased to the ambient pressure of airspace 16.

In implementations whereby operation of this apparatus draws liquid upwards against the action of gravity, the dimensions of the airways, including those of air channels 19 through which air must pass to reach the chamber 56, may be chosen to allow, on opening of the valve, return of the liquid drawn up the conduit under hydrostatic pressure to the liquid supply, before shuttle 52*a* is returned to its initial position through the action of plunger 51*a* pushing on the shoulder 20. In this way it can be arranged that little or none of the liquid drawn up the conduit is subject to a significant positive pressure either on its supply from or its return to the liquid supply. This feature is advantageous for liquid receiving or dispensing means whose action is degraded by positive pressures, examples of which are given below.

FIG. 5 shows, by way of example, a further form of piston/valve mechanism that may be used in the apparatus of the invention. This piston/valve mechanism takes the form of an 'exterior' piston; 'exterior' in the sense that the elements defining the piston/valve assembly lie exterior to the cylinder wall 23. It is to be understood that the continuation of walls 23 extend into the walls defining conduit 3.

The apparatus of FIG. 5 also incorporates an optional impermeable pressure-transmitting membrane 24 defining an airspace 28. (In the absence of membrane 24 the air space may simply be taken to be the volume between the piston/valve assembly and the surface of the liquid within the open end of said conduit that in use is immersed in liquid.) Incorporation of this membrane allows liquid uptake and discharge without liquid contacting the valve, which is particularly useful if the liquid is resinous or is a dense suspension of solid particulates, when liquid contact to the valve could cause blockage of the valve.

The piston/valve mechanism comprises an outer rigid cap 32, an elastomeric seal material 33 that is able to slide axially, an inner cylinder wall 23. Elastomeric seal material 33 will again, without loss of generality, be described as an O-ring. The sliding O-ring 33 is able to move within the confines of a wide groove 25 formed on the outer circumference of cylinder wall 23 so that it is locally reduced in thickness. Sliding O-ring 33 is otherwise in radial compression between cylinder wall 23 and outer cap 32 thereby maintaining a seal between those elements at all times.

At certain circumferential positions around the groove 25 discrete slots 26 are formed in the outer surface of the cylinder wall 23 and extending axially for a distance larger than the axial extent of the sealing contact made between O-ring 33 and groove 25. Preferably, slots 26 are substantially perpendicular to the groove 25. The position of the slots 26 in relation to the groove 25 is such that when the sliding O-ring 33 is situated at the lower edge 27 of groove 25 air can pass behind the O-ring 33 through slots 26. In this circumstance internal airspace 28 is in direct contact with external airspace 28*a*, which is at ambient pressure, rendering the valve "open".

Frictional forces between the cap 32 and O-ring 33 cause the O-ring to move along the groove 25 towards position 30 when cap 32 is displaced in the direction shown by arrow 72. At position 30 the O-ring 33 has moved beyond the extent of the slots 26 and is in intimate contact with the upper edge 311 of the groove 25. In this position the internal airspace 28 is not in direct contact with external air space 28*a* rendering the valve "closed". Further displacement in the direction shown by arrow 72 of the cap 32 increases the volume of the now-'closed' air space 28, so reducing the pressure therein as the cap slides past the O-ring 33 now held captive at position 30.

Optional flexible membrane 24 moves to reduce the volume of air space 28 thereby to accommodate the reduction in pressure. It correspondingly increases the volume of the interior airspace between membrane 24 and the liquid within conduit 3 thereby transmitting the pressure reduction to the liquid supply conduit 3. The pressure difference between the near ambient pressure in the vessel and the reduced pressure in the liquid supply conduit causes the liquid surface 62 to move in the direction of the arrow 8 along the conduit.

Frictional forces between the cap 32 and O-ring 33 cause the O-ring to move along groove 25 towards position 30*a* when cap 32 is displaced as shown by arrow 71. At position 30*a* the O-ring 33 has moved over the axial region of the groove 25 containing the slots 26, exposing those slots, and now makes contact with the lower edge 27 of the groove 25. In this circumstance air can pass behind O-ring 33 through slots 26 causing internal air space 28 to be in direct contact with external ambient air space 28*a* rendering the valve "open". Consequently the pressure in internal air space 28 is restored to ambient pressure. Optional flexible membrane 24, if present, moves to accommodate the increase in pressure and transmits this pressure increase to the liquid supply conduit 3. When, for example, the apparatus is oriented such that the conduit 3 extends above the level 61 of liquid within the vessel and liquid has been raised above that level in the conduit, this opening of the valve allows liquid previously drawn into the conduit to withdraw from said conduit under the action of the hydrostatic head of the liquid in the conduit and return to the vessel.

In all embodiments of the apparatus herein described there may be included liquid receiving or dispensing apparatus in fluid contact with the interior volume of the conduit between the piston/valve assembly and the liquid-immersed end of the conduit, as indicated for example at 4 in FIGS. 1 and 2. Examples of receiving means include a liquid metering chamber and a reagent layer chemically sensitive to the liquid. Examples of liquid dispensing means include liquid droplet generating means 600 based on a perforate component 610 separating the interior conduit volume from the ambient exterior environment, such as those known in the 'ink jet' art and in the art of electromechanical excitation either of the liquid interior to the perforations 610 or of material regions defining those perforations 610 (FIG. 8).

Particular advantage arises in use with such types of liquid dispensing means when the apparatus is oriented such that the surface of liquid drawn up the conduit to reach the dispensing means is at a higher level than the level of the liquid within the vessel, since these generally operate most effectively when the pressure of liquid at the interior orifices of those perforations 610 is lower than the pressure at the exterior orifices. (By 'exterior' orifices we mean the orifices of the perforations 610 at the outer, ambient-environment surface of the perforate component). Of particular note are the apparatuses for liquid aerosol sprays disclosed in U.S. Pat. No. 4,533,082, U.S. Pat. No. 4,605,167, U.S. Pat. No. 4,796,807, U.S. Pat. No. 4,602,538, EP 0 655 256 A2, U.S. Pat. No. 5,729,724, U.S. Pat. No. 3,812,854, EP 0 480 615 A1, GB 92/11050, EP 0 516 565 A1, U.S. Ser. No. 152,716, GB 2 261 494, EP 0 554 723, PCT/GB92/02262, PCT/GB94/02692. Further, the inventors have found that, by maintaining this pressure drop below that at which air is ingested through the perforations 610 faster than the dispensing apparatus can dispense liquid, the dispensing means themselves can maintain a continual replenishing supply of liquid from the liquid source to the dispensing means once direct fluid contact between the liquid receiving or dispensing means and the vessel is established by the action of the expandable chamber 56 and valve.

The best type of liquid dispensing means for use with the present invention presently known to the inventors are those in accordance with patent application PCT/GB92/02262.

In embodiments incorporating also the membrane 533 referred to above, the liquid dispensing or receiving means is disposed between the membrane 533 and the open end 556 of the conduit 552.

With such dispensing apparatus, it is advantageous for there to be present a seal covering the orifices of those perforations 610 at the exterior face of the conduit during the expansion of the chamber 56 and the consequent uptake of liquid into the conduit, at least until the orifices of those perforations 610 at the interior face of the conduit are contacted by the uptaken liquid. Said seal may thereafter be displaced to allow liquid dispensation from the conduit to the ambient environment. This will be described in greater detail with reference to FIG. 7. That displacement may, for example, arise through mechanical coupling of the position of said seal to the state of expansion of the expandable chamber.

FIG. 6 shows a liquid container and dispensing means 60 defined by a rigid casing 51; a conduit 522 penetrating through that casing and having one end 556 with its opening within the interior volume 64 of the container and a second end 57 with an opening exterior to said container, thereby providing a liquid passageway between the interior volume 64 and the exterior environment; an aperture 544 penetrating through the casing and sealed against liquid ingress or egress by an impermeable pressure-transmitting membrane 533 capable of expanding to reduce interior volume 64 responsively to pressure differences across the membrane. In use, the container 60 is at least partially filled with liquid.

The apparatus may also include a removable second seal 555 capable of sealing the opening 57 of the conduit 52. Second seal 555 allows simple liquid containment regardless of the orientation of the container 60. Second seal 555 may be replaceable; this allows multiple actions, in each of which partial dispensing of liquid from the container may occur and after each of which the second seal 555 may be replaced, thereby again allowing liquid containment between dispensing actions regardless of the orientation of the container.

In embodiments without a second seal 555, liquid containment may be achieved by maintaining container 60 oriented such that the upper surface 61 of liquid within the container remains at lower height than the height of opening 57.

In a first use as a dispensing means, second seal 555, if present, is removed and container and dispenser 60 is re-oriented from a first orientation, in which the upper surface 61 of contained liquid is at a height below the height of opening 57 of the conduit, to a second orientation such that the upper surface of the liquid is displaced to a height above the height of that opening 57. Liquid thereby exits from the container via opening 57 at or outside the external face of the casing 51 of container 60. On returning container 60 to its original orientation, air may enter into the container via the second conduit 522 to replace the discharged liquid.

When used according to this dispensing method and when the diameter of second conduit 522 is sufficiently small that during discharge of liquid from said second conduit air cannot at the same time enter container 60 therethrough, then two distinct methods of metering or controlling the volumetric discharge are possible. (Quite large diameters of the second conduit, up to 10 mm diameter in the experience of the inventors, can be operated to discharge liquid without admitting air.) In the first method, the interior volume of that part of the second conduit 522 interior to container 60 is selected to be larger than the maximum volume to which the membrane 533 may expand within the container. In this case the maximum volumetric discharge of liquid from container 60 on its reorientation is limited by that maximum volume of the membrane 53. In the second method, the maximum volume to which the membrane 53 may expand within the container is selected to be larger than the interior volume of that part of the second conduit 52 interior to container 60. In this case the maximum volumetric discharge of liquid from container 60 on its reorientation is limited by the part-volume of the second conduit.

In a second use of container 60 for liquid dispensing, the open end 56 of the conduit 52 is immersed in liquid; second seal 55, if present, is removed; and open end 57 of the second conduit 52 is exposed to a reduced pressure such that the pressure in the region of end 57 is lower than the pressure at the surface of membrane 53 exposed to the airspace 62 and container aperture 54. Liquid is thereby drawn out of the container via the conduit 52. On removing the source of reduced pressure at least partial return of liquid via the conduit 52 into the container may be effected.

According to this second method, the maximum volume that may be withdrawn from container 60 in any one cycle of pressure reduction followed by pressure restoration may conveniently be limited by the maximum volumetric expansion of the membrane 53. Again, it may be arranged by reorientation or other means, that air passes into the container to replace liquid discharged from it, allowing the membrane 53 at least to partially collapse and thereby to allow multiple discharge operations to its fully-expanded volume.

An advantageous means to provide the reduced pressure and so induce liquid delivery according to the second method described above is the apparatus described above in accordance with the first aspect of the invention. This allows, for example, the creation of liquid dispensing products comprising a liquid container 60 that is separable from an apparatus 1 for the supply of liquid to a liquid receiving or dispensing means. This allows for example, products in which the first embodiment of the invention forms a part of such a product that is capable of discharging liquid to the ambient environment and is reusable, and the second embodiment of the invention forms a part of such a product that is removable from that first part and is refillable or disposable.

Particularly when used according to the second method described above, the membrane 53 may advantageously have a surface area greater than the minimum area enclosed by the seal that it forms with the casing 51 of container 60. In this way it is capable of expansion to reduce the interior volume of container 60 without substantial stretching of its membrane material, and so with very low pressure drop across the membrane opposing the expansion or contraction.

This apparatus therefore provides a relatively simple and low cost apparatus for supply of liquid, particularly for that supply at a pressure less than or equal to the ambient pressure.

FIG. 7 shows one practical embodiment of a liquid supply apparatus combining a "closed" container 60 (of the general form of vessel 22 as described with reference to FIG. 2 and as described with reference to FIG. 6) and a liquid supply apparatus as described with reference to FIGS. 1 to 5 inclusive.

The main operating principle relies on the displacement of a rigid cap 32 relative to the body 36 of the liquid supply apparatus. In this way the cap acts as an 'exterior piston', and allows expansion and contraction of the air space 28 within the chamber partially defined by the cap 32. As cap 32 is displaced upwards as shown by the arrow 72 from the body 36, the valve in the piston/valve mechanism 34 closes as has been described in relation to FIG. 5. Thereafter, as the cap is displaced further upwards the pressure in air space 28 reduces. Flexible membrane 24 moves upwards to accommodate the change in pressure and transmits this pressure reduction to the liquid supply conduit 52. The conduit couples together, in a fluid-tight manner, with conduit 3 of the liquid supply apparatus. Therefore liquid will flow from the container 60 at ambient pressure into the conduit 52 and thence into conduit 3 at reduced pressure, towards the liquid receiving or dispensing means denoted by 43 and 48.

Flexible membrane 24 presents an impermeable barrier preventing liquid egress from the liquid supply apparatus via the piston/valve mechanism and prevents liquid contaminants from within the liquid supply apparatus becoming deposited on the piston/valve mechanism. Such deposition could have an unfavourable effect on the operation of the piston/valve mechanism particularly where the liquid concerned contains either a suspension of particulates or a resin solution, as has been described above.

Liquid level 61 in container 60 is maintained at ambient pressure by the pressure-transmitting flexible membrane 53 via a vent hole 54 as described in relation to FIG. 6. The pressure difference between the pressure of liquid within liquid supply conduit 3 and/or the conduit 52 and the upper surface 61 of the liquid in container 60 causes liquid to flow from the container 60 upwards through the conduit 52 towards the liquid receiving or dispensing means shown at 43 and 48. The end of the upwards cap displacement shown by arrow 72 is typically arranged so that the liquid in the conduit 52 will rise to a typical level 44, slightly above the level of the liquid dispensing means shown at 48 and 43. Corresponding to the reduction of liquid in container 60, compensating airflow enters the outer-walls of liquid container through vent 54, expanding second membrane 53. Second membrane 53 prevents that air from making contact with the liquid in the container. With liquid at or above the level of said liquid dispensing means, said means may remain in direct fluid contact with the container 60 for as long as the valve of the piston/valve assembly shown at 34 remains closed. This is achieved if cap 32 remains at the end of its upward displacement and said liquid dispensing means thereafter replenishingly maintains direct fluid contact with container 60 as it dispenses a volume of supplied liquid less than or equal to the volume of liquid contained in container 60. A particular example of this is described below by reference to dispensing means comprising one or more nozzles.

When the cap 32 is displaced downwards as shown by arrow 71 the sliding seal (described as a sliding O-ring) in the piston/valve mechanism 34 moves downwards as described in relation to FIG. 5. In this circumstance the valve part of the piston/valve mechanism 34 becomes "open" and the pressure in air space 28 increases to ambient pressure as described in relation to FIG. 5. The hydrostatic pressure of that liquid below the level shown at 44 in the liquid supply conduit 3 and second conduit 52 now exceeds the ambient pressure at liquid level 61 in the container 60. This difference in pressure causes the liquid to return towards the container 60 until the hydrostatic pressure in the liquid supply conduit 52 reaches ambient pressure (or the valve within the piston/valve assembly is again closed by a repeated motion of cap 32 in the direction shown by arrow 72). As liquid returns to the container 60 the flexible second membrane 53 partially collapses to accommodate the increasing liquid volume while exhausting air through air vent 54.

By incorporating flexible second membrane 53 as part of the liquid supply means an impermeable barrier preventing liquid egress from the air vent 54 is provided, giving further functionality. Furthermore, second membrane 53 can enable a metered or limited maximum dose liquid delivery to liquid receiving or dispensing means as described with reference to FIG. 6.

By way of further example, the liquid supply apparatus shown in FIG. 7 may be constructed to have a low-cost liquid container 60 removable along interface 46. Such a container may form part of a refillable or disposable component. When the liquid in the container 60 becomes depleted the container can be removed and replaced or refilled.

In this circumstance the liquid supply conduit 52 can have an integral deformable second seal 46 which is opened by attachment of the container 60 but otherwise remains closed. In this way the liquid supply apparatus is substantially reusable and the container can be either refillable or disposable. The deformable seal 46 prevents liquid egress from the interface between the container 60 and the rest of the liquid supply apparatus.

By way of further example, the liquid supply apparatus shown in FIG. 7 may incorporate a liquid receiving or dispensing means shown at 43 and 48 wherein component 48 is a porous or perforated material component such as would be found, for example, on an aerosol generating device according to U.S. Pat. No. 4,533,082, U.S. Pat. No. 4,605,167, PCT/GB92/02262, PCT/GB94/02692, U.S. Pat. No. 5,152,716, GB 2 261 494, U.S. Pat. No. 4,796,807, U.S. Pat. No. 4,602,538, EP 0 655 256 A2, U.S. Pat. No. 5,729,724, U.S. Pat. No. 3,812,854, EP 0 480 615 A1, GB 92/11050, EP 0 516 565 A1, U.S. Ser. No. 152,716, EP 0 554 723. Component 43 may comprise a piezoelectric actuator optionally coupled to a material layer intermediate between it and the perforate material component.

In operation many of such devices may, once liquid supply to them is achieved using the liquid supply means described herein, themselves replenishingly maintain liquid supply to the rear face of said perforated component responsively to the dispensation as droplets of liquid through said perforations. This replenishing supply may similarly be maintained from a wide variety of ink jet devices. Either of such types of droplet-dispensing devices may operate in the liquid-replenishing mode when the pressure of the liquid brought to them is not so low (relative to the pressure of the ambient air into which the droplets are ejected) that air is ingested through the perforations (the so-called 'bubble-point' pressure). This can be achieved if said perforations are sufficiently small. However this is not a necessary condition and, indeed, air may be ingested by such droplet-dispensing devices as they eject liquid droplets. If the air ingestion exceeds the liquid dispensation the 'excess' liquid volume (i.e. that above the height of the liquid dispensing means) reduces as it expels droplets. Air ingestion through perforations in the dispensing means (for example, during restoration of undispensed liquid remaining in the liquid conduit to container 60) can enter container 60 when dispensation is finished and the valve then subsequently opened. Such airflow into container 60 contributes to the collapse of second membrane 53 ready for the next cycle of operation. In turn, this collapse allows for multiple cycles of operation without second membrane 53 fully inflating prior to liquid reaching the liquid dispensing means via the conduit.

However, such perforations provide a direct or indirect air path between the liquid supply conduit 52 and ambient pressure during the 'priming' half-cycle (as described above). This prevents liquid from being so effectively drawn from the liquid supply to the dispensing means. To restore that effective operation, this air path may be closed during the priming half-cycle at least until liquid covers the perforations of the dispensing means. This allows the pressure to be adequately reduced in liquid supply conduit 52 as the cap 32 is displaced upwards.

This air path can, for example, be closed during this priming half-cycle by forming a sliding seal between a mounting 49 of the liquid receiving or dispensing means and the inside diameter of the cap 32. For example, the cap can incorporate a 'door' aperture 50 located at one circumferential position in the cap 32 and which slides into position in front of the liquid receiving or dispensing means after the liquid level in the liquid supply conduit has covered the perforations at 48. Thereafter as the cap 32 continues to move upwards as shown by arrow 72 the air path between the liquid supply conduit 3 and conduit 52 and ambient pressure is effectively closed by the liquid itself, provided that the pressure difference between the liquid at those perforations and the ambient pressure does not exceed the 'bubble-point' pressure described above. In many situations, this is a straightforward matter to arrange.

Similarly, it is desirable in some applications that the height difference between the height 44 of the liquid above the height of the perforations at 48 that results either from the priming half-cycle or resulting at the end of liquid dispensing by said dispensing apparatus is not sufficient, when valve assembly shown at 34 opens to allow 'de-priming', to cause liquid to emerge out through said perforations. This requires the height difference to be such that, with surface 44 now at atmospheric pressure, the pressure of liquid at the height of the perforations does not exceed the 'bubble-point pressure' discussed above.

A spiral thread between cap 32 and body 36 allowing simultaneous rotation and axial displacement of the cap relative to the body is very convenient to allow the aperture in front of the dispensing means to open at the appropriate time.

It is understood that at least some of said aerosol generating devices operate most effectively if liquid is supplied to them at a pressure lower than the pressure of the ambient environment into which they dispense droplets. In such aerosol devices said pressure difference maintains preferential curvature of the menisci of the supplied liquid within the orifices of the perforations. The present invention is operable to supply liquid, particularly liquid suspensions that have tendency to sedimentation, to such aerosol generating devices in a simple and cost effective manner.

What is claimed is:

1. A liquid supply apparatus comprising:

a liquid supply conduit having rigid walls and an open end which, when in use, is immersed in a liquid to be supplied, an expandable chamber in pressure-transmitting relation to an interior volume of said conduit and operable to provide interior volume change between said chamber and said open end of said conduit, a valve between at least one of the interior volume of said conduit and said chamber and the ambient atmosphere that is operable to open and close and, when open, allows at least air or other gases to be admitted into or exhausted from said interior volume and, when closed, prevents such admission or exhaustion, wherein, the expandable chamber is mechanically linked to the valve so that expansion of the interior volume of said chamber, or the expansion of that volume and subsequent coming to rest from that expansion, maintains the valve in a closed state, and including at least one of a liquid receiving and dispensing means in fluid contact with part of the interior volume of said conduit between the expandable chamber and the open end of said conduit.

2. Apparatus according to claim 1, wherein said liquid dispensing means incorporates at least one perforation passing from said interior volume to the ambient environment outside said conduit.

3. Apparatus according to claim 2, wherein said liquid dispensing means comprise a droplet production device operating by electromechanical excitation either at least one of the liquid interior to the perforations and the material regions defining the perforations.

4. Apparatus according to claim 2, wherein the liquid has a bubble point pressure and the expansion of said expandable chamber, the volume of the conduit, the position along the conduit of liquid dispensing means, and the mechanical coupling between the movable seal and the expandable chamber are chosen such that, on expansion of said expandable chamber from its minimum to its full volume, the amount of liquid drawn up through the open end of said conduit immersed in liquid and which passes beyond said position of said liquid dispensing means is sufficiently small such that, in any orientation of the apparatus, the maximum hydrostatic head presented by said liquid at said perforations on subsequent contraction of the expandable chamber and consequent opening of said valve, is smaller that the bubble-point pressure of the liquid contacting said perforations.

5. A method of liquid delivery using apparatus of claim 1, wherein the conduit includes a continuation extending therefrom for receiving the valve therein.

6. Apparatus according to claim 1, in which said mechanical linkage causes said valve to open responsively to contraction of the interior volume of said chamber.

7. Apparatus according to claim 1, wherein said conduit extends above the height of the liquid source in which the end is immersed, so that the apparatus takes up liquid against gravity from, and returns liquid with the assistance of gravity to, the liquid source.

8. Apparatus according to claim 1 wherein said expandable chamber includes a rigid movable closure element closing an end of said conduit not immersed in liquid, wherein said closure element is capable to move along the length of said conduit selectively to increase and decrease the interior volume thereof.

9. Apparatus according to claim 8, wherein the rigid movable closure element comprises an impermeable material component assembly incorporating the valve including a shuttle and plunger for selectively sealably engaging at least one of an exterior and interior surface of the conduit.

10. Apparatus according to claim 9, in which said shuttle and plunger are adapted to maintain a seal between said shuttle and said plunger as said shuttle is displaced along said conduit by said plunger, and to maintain an airtight seal between said shuttle and said conduit only when at least one of said shuttle displaces in the direction to increase conduit interior volume and when said shuttle comes to rest after displacing in such direction.

11. Apparatus according to claim 10, wherein the impermeable material component assembly includes ring means comprising at least one of an O-ring and a U-ring seal between the sidewalls of the conduit and the shuttle.

12. Apparatus according to claim 11, wherein opening of said valve is effected by motion of said shuttle in a direction to reduce said chamber volume, to separate a surface of the shuttle from a sealing face of the ring means to expose an air passage to the ambient environment.

13. Apparatus according to claim 9, in which said shuttle maintains a seal between the sidewalls of said conduit and said shuttle as said shuttle is displaced along the length of said conduit so that said shuttle also forms an airtight seal to said plunger only when at least one of said shuttle and plunger displace in the direction of increasing conduit interior volume and when said shuttle and plunger come to rest after displacing in such direction.

14. Apparatus according to claim 9, wherein the impermeable material component assembly includes at least one of an O-ring and a U-ring seal between the sidewalls of the conduit and the shuttle.

15. Apparatus according to claim 14, wherein said membrane has surface area greater than the minimum area enclosed by the seal that it forms with the walls of said conduit.

16. Apparatus according to claim 1, further comprising a liquid-impermeable pressure-transmitting membrane attached to the walls of said conduit forming a liquid-tight seal of said conduit between said expandable chamber and the open end of the conduit, said membrane being capable to expand and to reduce the interior conduit volumes between the membrane and the open end of the conduit, and correspondingly between the membrane and the expandable chamber, responsive to pressure differences between the expandable chamber and that part of the conduit on an opposite side of the membrane to said chamber.

17. Apparatus according to claim 16, and additionally comprising means for at least one of receiving and dispensing liquid in fluidic contact with that part of the interior volume of said conduit between said membrane the expandable chamber and the open end of said conduit for at least one of receiving and dispensing liquid.

18. Apparatus according to claim 17, wherein said means is located at a height above an upper surface of the liquid of the liquid source, so that, in use, said means receives liquid at a pressure lower than ambient pressure outside the conduit and discharges said received liquid from the open end of said conduit by the action of gravity acting on said liquid once said valve is opened.

19. A liquid containment and delivery apparatus comprising:

a rigid casing defining a container, a liquid conduit penetrating through said casing and having one end with opening within the interior volume of said container and a second end with opening exterior to said container, thereby to provide liquid passageway between the interior volume of said container and the environment exterior to said container, a pressure-transmitting aperture penetrating through said casing and sealed against liquid ingress and egress by an impermeable pressure-transmitting membrane capable to expand and to reduce the volume of the container interior to both the membrane and the casing responsively to pressure differences across said membrane, which is at least partially filled with liquid when in use, a removable seal sealing the opening of said conduit that is exterior to, or at the exterior surface of, said container, and wherein the maximum volume occupied by said membrane within said container is smaller than the interior volume of said container.

20. Apparatus according to claim 19, wherein said membrane has surface area greater than the minimum area enclosed by the seal that it forms with the walls of said conduit.

21. Apparatus according to claim 19, wherein the maximum volume occupied by said membrane within said container is larger than the interior volume of that portion of said conduit lying within said container.

* * * * *